US006899160B2

(12) United States Patent
McCullough

(10) Patent No.: US 6,899,160 B2
(45) Date of Patent: May 31, 2005

(54) METHOD OF FORMING A THERMALLY CONDUCTIVE ARTICLE USING METAL INJECTION MOLDING MATERIAL WITH HIGH AND LOW ASPECT RATIO FILLER

(75) Inventor: Kevin A. McCullough, Warwick, RI (US)

(73) Assignee: Cool Options, Inc., Warwick, RI (US)

( * ) Notice: Subject to any disclaimer, the term of this patent is extended or adjusted under 35 U.S.C. 154(b) by 68 days.

(21) Appl. No.: 10/605,041

(22) Filed: Sep. 3, 2003

(65) Prior Publication Data

US 2004/0104502 A1 Jun. 3, 2004

Related U.S. Application Data

(63) Continuation of application No. 09/757,896, filed on Jan. 10, 2001, now abandoned.

(51) Int. Cl.[7] ..... C22C 47/14; C22C 49/02; C22C 49/14; B22D 23/06; B22D 25/06

(52) U.S. Cl. ..... 164/303; 164/91; 164/97; 419/10; 419/19; 419/23; 419/24

(58) Field of Search ..... 164/91, 97, 285, 164/303; 428/539.5, 293.1; 148/516; 419/10, 19, 23, 24

(56) References Cited

U.S. PATENT DOCUMENTS

| | | | | |
|---|---|---|---|---|
| 3,398,322 | A | 8/1968 | Lizasoain et al. | 174/110 |
| 3,673,121 | A | 6/1972 | Meyer | 252/511 |
| T904,012 | I4 | 11/1972 | Staniland | 252/503 |
| 3,708,387 | A | 1/1973 | Turner et al. | 161/168 |
| 4,098,945 | A | 7/1978 | Oehmke | 428/327 |
| 4,307,147 | A | 12/1981 | Ohishi et al. | 428/268 |
| 4,367,745 | A | 1/1983 | Welage | 128/303.13 |
| 4,470,063 | A | 9/1984 | Arakawa et al. | 357/67 |
| 4,496,475 | A | 1/1985 | Abrams | 252/514 |
| 4,568,592 | A | 2/1986 | Kawaguchi et al. | 428/107 |
| 4,664,971 | A | 5/1987 | Soens | 428/288 |
| 4,689,250 | A | 8/1987 | Quella et al. | 427/216 |
| 4,816,184 | A | 3/1989 | Fukuda et al. | 252/511 |
| 5,011,870 | A | 4/1991 | Peterson | 253/220 |
| 5,011,872 | A | 4/1991 | Latham et al. | 523/440 |
| 5,021,494 | A | 6/1991 | Toya | 524/404 |
| 5,037,590 | A | 8/1991 | Fukushima | 264/29.2 |
| 5,098,610 | A | 3/1992 | Okamura et al. | 252/511 |
| 5,106,540 | A | 4/1992 | Barma et al. | 252/511 |
| 5,180,513 | A | 1/1993 | Durand | 252/62.55 |
| 5,213,715 | A | 5/1993 | Patterson et al. | 252/518 |
| 5,225,110 | A | 7/1993 | Kathirgamanathan | 252/515 |
| 5,249,620 | A | 10/1993 | Guerriero et al. | 164/97 |
| 5,286,416 | A | 2/1994 | Teichmann et al. | 252/512 |
| 5,302,456 | A | 4/1994 | Matsui | 428/407 |
| 5,334,330 | A | 8/1994 | Rowlette | 252/512 |
| 5,373,046 | A | 12/1994 | Okamura et al. | 524/413 |
| 5,397,608 | A | 3/1995 | Soens | 428/34.5 |
| 5,400,505 | A | 3/1995 | Wei et al. | 29/889 |
| 5,445,308 | A | 8/1995 | Nelson et al. | 228/121 |
| 5,454,425 | A | 10/1995 | Kao | 164/520 |
| 5,490,319 | A | 2/1996 | Nakamura et al. | 29/596 |

(Continued)

*Primary Examiner*—Deborah Jones
*Assistant Examiner*—Jason L Savage
(74) *Attorney, Agent, or Firm*—Barlow, Josephs & Holmes, Ltd.

(57) ABSTRACT

The present invention discloses a conductive injection molding composition. The thermally conductive composition includes a metallic base matrix of, by volume, between 30 and 60 percent. A first thermally conductive filler, by volume, between 25 and 60 percent is provided in the composition that has a relatively high aspect ratio of at least 10:1. In addition, an alternative embodiment of the composition mixture includes a second thermally conductive filler, by volume, between 10 and 25 percent that has a relatively low aspect ratio of 5:1 or less.

20 Claims, 3 Drawing Sheets

U.S. PATENT DOCUMENTS 5,522,962 A 6/1996 Koskenmaki et al. .... 156/272.4
5,536,568 A 7/1996 Teruo ..... 428/327
5,552,214 A 9/1996 Kobomura et al. ..... 428/294
5,580,493 A 12/1996 Chu et al. ..... 252/511
5,660,923 A 8/1997 Bieler et al. ..... 442/377
5,669,381 A 9/1997 Hyatt ..... 428/402
5,681,883 A 10/1997 Hill et al. ..... 524/404
5,770,305 A 6/1998 Terasaka ..... 428/328
5,834,337 A 11/1998 Unger et al. ..... 438/122
5,851,644 A 12/1998 McArdle et al. ..... 428/213
5,863,467 A 1/1999 Mariner et al. ..... 252/511
5,945,217 A 8/1999 Hanrahan ..... 428/389
5,977,230 A 11/1999 Yang et al. ..... 524/389
5,981,085 A 11/1999 Ninomiya et al. ..... 428/614
6,048,919 A 4/2000 McCullough ..... 524/404
6,139,783 A 10/2000 McCullough ..... 264/40.1
6,303,096 B1 10/2001 Yamamoto et al. ..... 423/447.2
2002/0022686 A1 2/2002 Itoh et al. ..... 524/504
2002/0025998 A1 2/2002 McCullough et al. ..... 524/66

METHOD OF FORMING A THERMALLY CONDUCTIVE ARTICLE USING METAL INJECTION MOLDING MATERIAL WITH HIGH AND LOW ASPECT RATIO FILLER

CROSS REFERENCE TO RELATED APPLICATIONS

This application is a continuation of U.S. Ser. No. 09/757,896, filed Jan. 10, 2001 now abandoned.

BACKGROUND OF INVENTION

The present invention relates generally to an improved composite material. More specifically, the present invention relates to a thermally conductive composite material that is easily moldable or castable.

In the heat sink industries, it has been well known to employ solid metallic materials for thermal conductivity applications, such as heat dissipation for cooling semiconductor device packages. For these applications, such as heat sinks, the metallic material typically is tooled or machined from bulk metals into the desired configuration. However, such metallic conductive articles are typically very heavy, costly to machine and are susceptible to corrosion. Further, the geometries of machined metallic heat dissipating articles are very limited to the inherent limitations associated with the machining or tooling process. As a result, the requirement of use of metallic materials which are machined into the desired form, place severe limitations on heat sink design particular when it is known that certain geometries, simply by virtue of their design, would realize better efficiency but are not attainable due to the limitations in machining metallic articles.

It is widely known in the prior art that improving the overall geometry of a heat-dissipating article can greatly enhance the overall performance of the article even if the base material used in the heat sink is the same. Therefore, the need for improved heat sink geometries necessitated an alternative to the machining of bulk metallic materials. To meet this need, attempts have been made in the prior art to provide molded compositions that include conductive filler material therein to provide the necessary thermal conductivity. The ability to mold a conductive composite enabled the design of more complex part geometries to realize improved performance of the part.

The attempts in the prior art included the employment of a polymer base matrix loaded with a granular material, such as boron nitride grains. Also, attempts have been made to provide a polymer base matrix loaded with flake-like filler material. In addition, attempts have been made using Metal Injection Molding Material (MIM). These attempts are, indeed, formable into complex geometries but still do not approach the desired performance levels found in metallic machined parts and the MIM parts have a lower thermal conductivity than heat sinks machined from solid metal. In addition, known conductive plastic materials are undesirable because they are typically very expensive to manufacture because they employ very expensive filler materials. Still further, these conductive composite materials must be molded with extreme precision due to concerns of filler alignment during the molding process. Even with precision molding and design, inherent problems of fluid turbulence, collisions with the mold due to complex product geometries make it impossible to position the filler ideally thus causing the composition to perform far less than desirable.

Moreover, the entire matrix of the composition must be satisfactory because heat transfer is a bulk property rather than a direct path property such as the transfer of electricity. A direct path is needed to conduct electricity. However, heat is transferred in bulk where the entire volume of the body is employed for the transfer. Therefore, even if a highly conductive narrow conduit is provided through a much lower conductive body, the heat transfer would not be as good as a body which is consistently marginally conductive throughout the entire body. Therefore, consistency of the thermal conductivity of the entire matrix of the composite body is essential for overall high thermal conductivity.

In view of the foregoing, there is a demand for a composite material that is highly thermally conductive. In addition, there is a demand for a composite material that can be molded or cast into complex product geometries. There is also a demand for such a moldable article that exhibits thermal conductivity as close as possible to purely metallic conductive materials while being relatively low in cost to manufacture.

SUMMARY OF INVENTION

The present invention expands upon the concepts and advantages of prior art thermally conductive plastic compositions. In addition, it provides new advantages not found in currently available compositions and overcomes many disadvantages of such currently available compositions.

The invention is generally directed to the novel and unique thermally conductive metallic composite material with particular application in heat sink applications where heat must be moved from one region to another to avoid device failure. The composite material of the present invention enables a highly thermally conductive composite material to be manufactured at relatively low cost. The thermally conductive composition includes a Metal Injection Molding Material (MIM) base matrix of, by volume, between 30 and 60 percent. The base matrix is preferably aluminum but may be other metal materials. Thermally conductive filler, by volume, between 25 and 60 percent is provided in the composition that has a relatively high aspect ratio. In addition, a second low aspect ratio thermally conductive filler may also be provided to bridge any breaks in continuity and conductivity paths of the high aspect ratio filler.

During the molding process of the composition of the present invention, the mixture is introduced into a mold cavity and flows into the various part geometries. The high aspect ratio filler generally aligns with the flow of the mixture in the mold and provides enhanced pathways for thermal conductivity through the already thermally conductive metallic part. By carefully controlling the flow of the injection material through the mold, the part will have enhanced thermal conductivity in the pathways created by the filler material. In addition, the filler material will increase the bulk heat transfer properties of the overall part geometry as well. In an alternative embodiment a low aspect ratio filler is also added to the injection mixture to fill the voids between the high aspect ratio filler in the mixture. As a result, the number of interfaces and base matrix thickness between filler members is greatly reduced thus resulting in thermal conductivity and performance superior to that found in prior art thermally composite materials.

It is therefore an object of the present invention to provide a conductive composite material that has a thermal conductivity much greater than found in prior art composites.

It is an object of the present invention to provide a conductive composite material that is moldable.

It is a further object of the present invention to provide a low cost conductive composite material.

Another object of the present invention is to provide a conductive composite material that enables the molding of complex part geometries.

It is yet a further object of the present invention to provide a conductive composite material that has an improved thermal conductivity over to pure Metal Injection Materials.

BRIEF DESCRIPTION OF DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION

Figure 1:
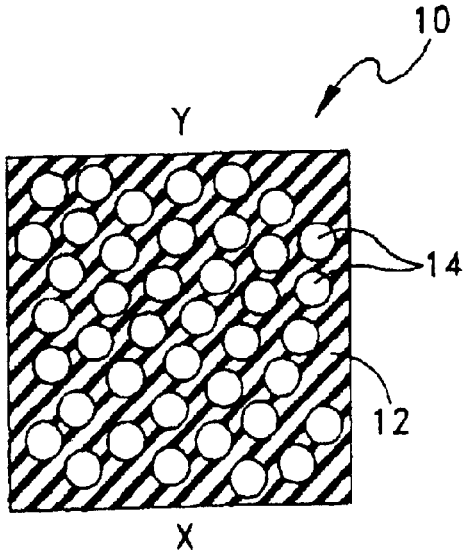
FIG. 1 (PRIOR ART)
FIG. 1 is a cross-sectional view of a prior art thermally conductive composite material employing a low aspect ratio filler in a base matrix.
Figure 2:
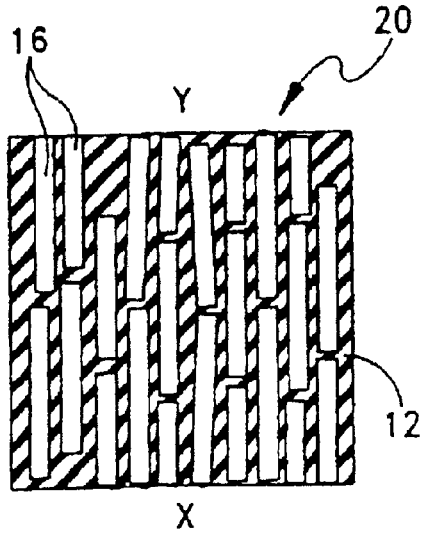
FIG. 2 (PRIOR ART)
FIG. 2 is a cross-sectional view of a prior art thermally conductive composite material employing a high aspect ratio in a base matrix with filler shown in theoretical ideal alignment.

Referring first to FIGS. 1 and 2, various prior art composite materials 10 and 20, which are readily commercially available, are shown. In particular, these prior art composite materials 10 and 20 generally show a base matrix of polymer 12, for example, with different types of filler material 14 and 16. Each of these compositions is shown in enlarged detail for clarity and ease of illustration.

As seen in FIG. 1, a cross-sectional view of a prior art composite material 10 with a base polymer matrix 12 and spheroid filler 14 is provided. In this prior art example, the base matrix 12 is loaded with low aspect ratio filler 12 that typically has a length to width ratio less than 5:1. For example, the mixture may include, by volume, 40 base matrix and 60 percent granular or spheroid filler. The base polymer matrix 12 is, essentially, non-conductive and the spheroid filler 14 is a metallic material or boron nitride which has an independent thermal conductivity of on the order of approximately 400 W/m°K.

As can be understood, the loading of thermally conductive filler in a polymer base matrix will render the material thermally conductive while permitting the material to be moldable. When employed as a thermal conductor, the material 10 must thermally transfer heat from, for example, side X to side Y of the material. During this transfer, heat must travel from heat conductive filler member to the adjacent heat conductive filler member to travel the path from X to Y. Since the selected filler in FIG. 1 are low aspect ratio granular or spheroid members, heat must cross many interfaces between several filler members as well as the non-conductive polymer residing there between. The more interfaces that heat must cross and the more polymer the heat must pass through, the more degraded the thermal conductivity will be. Further, too much loading of filler material would prevent the base polymer from wetting out resulting in undesirable small air pockets in the finished molded product.

Turning now to FIG. 2, an ideal prior art composition 20 shows the employment of high aspect ratio filler 16 within a polymer base matrix 12. FIG. 2 illustrates the efforts to solve the aforementioned problems associated with having too many interfaces and too much polymer between the two points of heat travel. FIG. 2 shows an ideal composition 20 where high aspect ratio filler 16 is perfectly aligned within polymer base matrix 12. In this ideal composition 20, high aspect ratio filler 16 aligns perfectly to reduce the number of interfaces the heat must cross and the volume of polymer 12 the heat must travel through. In this ideal composition, only two or three interfaces are encountered when going from point X to Y as opposed to the 7 or 8 encountered by composition 10 shown in FIG. 1.

While composition 20 shown in FIG. 2 is ideal and preferred, it is virtually impossible to achieve in actual practice. This is primarily due to geometry of the part to be molded. As stated earlier, one of the primary reasons for employing a thermally conductive plastic composition is that it is moldable into more complex geometries to achieve better heat dissipation. Therefore, intricate part geometries are typically encountered when molding thermally conductive polymer materials.

Figure 3:
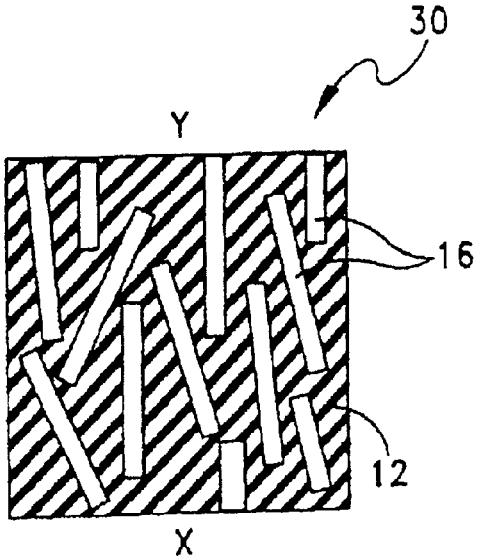
FIG. 3 is a cross-sectional view of a thermally conductive composite material employing a high aspect ratio filler in a base matrix with filler shown in accordance with the present invention.

With these intricate geometries, turbulence of the flow of the filler loaded matrix is common resulting in collisions of the filler material and non-uniform alignment. While parallel aligned of the high aspect ratio filler is obviously preferred, it cannot be attained. Further, the turbulence of flow and collisions with edges of the mold often breaks the high aspect ratio filler particularly when it has an aspect ratio larger than 20:1. FIG. 3, showing the preferred embodiment of the present invention, illustrates a realistic composition 30 with filler 16 being somewhat aligned to adjacent filler 16 within polymer 12. FIG. 3 is what is encountered in the field, due to the inherent problems associated with molding material with filler therein, as opposed to the theoretically ideal arrangement shown in FIG. 2. As can be seen in FIG. 3, the number of interfaces or transitions from one filler 16 to another to travel from point X to Y is reduced as compared to FIG. 1, however, the volume of non-thermally conductive polymer material in the path of travel is increased thus greatly reducing the overall conductivity of the composition through the path X to Y. Further, breakage of the high aspect ratio filler 16 will cause the thermal conductivity of the composition to degrade as well.

The base matrix material is preferably aluminum but may be other MIM metallic materials, such as copper, brass, alumina, magnesium or other alloys. For the preferred embodiment of the present invention in FIG. 3, the high-aspect ratio filler material is preferably carbon material in a fiber configuration but may be aluminum, alumina, copper, magnesium or brass in a wide array of configurations, such as grains, whiskers, fiber or flakes. As employed in the alternative embodiment of FIG. 4, the low aspect ratio filler may be boron nitride, carbon material. The low aspect ratio filler is preferably granular in configuration.

FIGS. 5–8 illustrate various filler configurations which are suitable for employment in the present invention. For the high aspect ratio filler, as employed both FIGS. 3 and 4, the aspect ratio of length L to thickness T is at least 10:1. Further, the material employed for the high aspect ratio filler 116 may be aluminum, alumina, copper, magnesium, brass and carbon. Moreover, in an application requiring only thermal transfer, the particular high aspect ratio filler may be specifically selected to enhance thermal conductivity with no concern as to the affect on electrical conductivity. Similarly, in an application requiring only electrical conductivity properties, the filler may be selected without regard to the thermal conductivity of the filler. Of course, filler may be selected that is both highly thermally conductive and electrically conductive to suit such an application.

Figure 4:
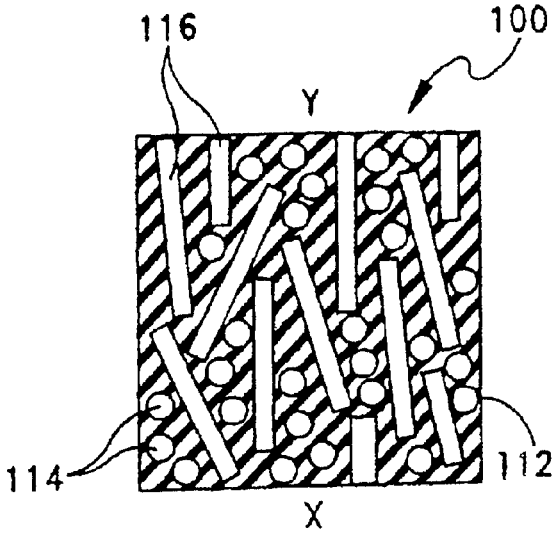
FIG. 4 is a cross-sectional view of the thermally conductive composite material in accordance with an alternative embodiment of the present invention employing both high aspect ratio filler and low aspect ratio filler.
Figure 5A:
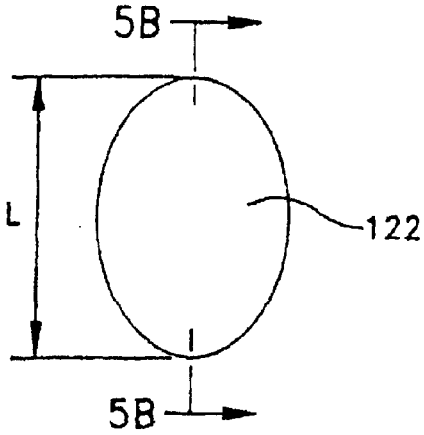
FIG. 5A is a top view of a high aspect ratio filler member of a flake-like configuration.
Figure 5B:
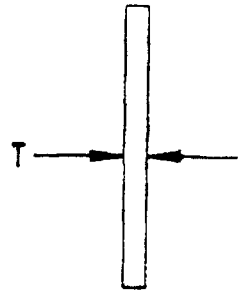
FIG. 5B is a cross-sectional view through the line 5B—5B of FIG. 5A.
Figure 6A:
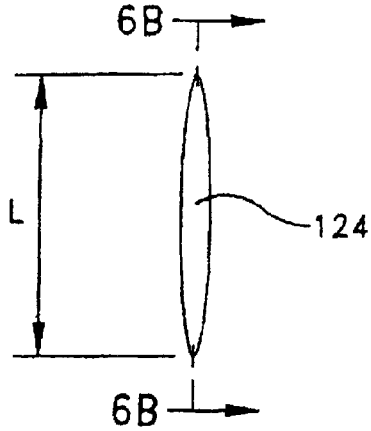
FIG. 6A is a top view of a high aspect ratio filler member of a rice-like configuration
Figure 6B:
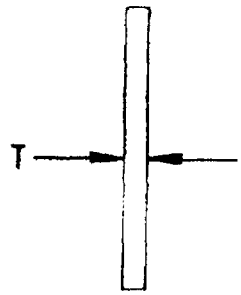
FIG. 6B is a cross-sectional view through the line 6B—6B of FIG. 6A.
Figure 7A:
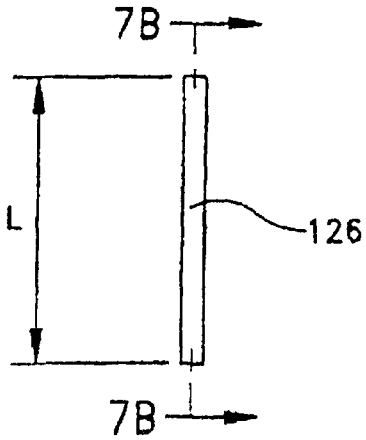
FIG. 7A is a top view of a high aspect ratio filler member of a strand-like configuration.
Figure 7B:
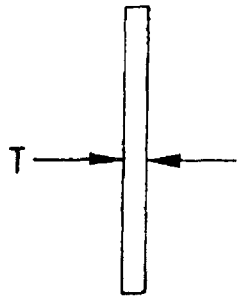
FIG. 7B is a cross-sectional view through the line 7B—7B of FIG. 7A.
Figure 8:
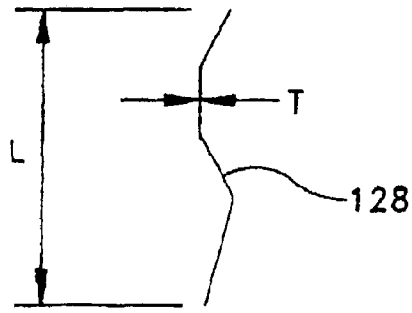
FIG. 8 is a top view of a high aspect ratio filler member of a whisker-like configuration.
Figure 9:
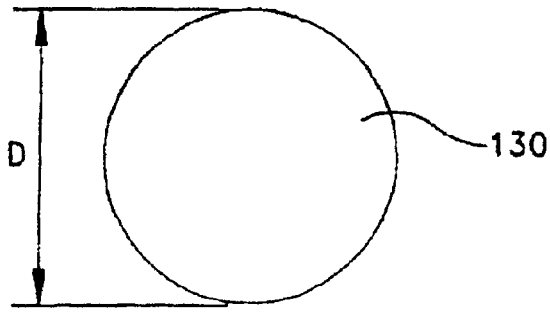
FIG. 9 is a top view of a low aspect ratio spheroid filler member.
Figure 10:
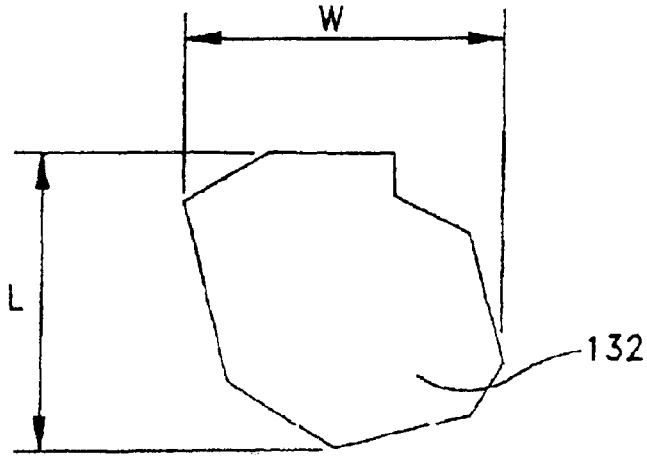
FIG. 10 is a top view of the a low aspect ratio grain filler member.

Turning now to FIGS. 9 and 10, two examples of suitable low aspect ratio filler configurations are shown which are employed in the composition of FIG. 4. FIG. 9 shows a substantially spheroid filler configuration 130 where the diameter of the member is D. As a result, the aspect of this filler configuration is approximately 1:1. In addition, FIG. 10 illustrates a grain-like or granular filler configuration 132 to serve as the low aspect ratio filler 114. This granular configuration 132 is somewhat random in shape and may have height L to width W ratio of 2:1, or the like. The low aspect ratio filler 114, in accordance with the present invention, is of a ratio of 5:1 or less. Further, the material employed for the low aspect ratio filler 114 may be aluminum, alumina, copper, magnesium, brass and carbon. The low aspect ratio filler is preferably approximately $^{10}/_{1000}$ of an inch in diameter or along its width but may be of different sizes depending on the application at hand. As with the high aspect ratio filler, the low aspect ratio filler may be selected to enhance thermal or electrical conductivity. Further, the low aspect ratio may be selected that has both thermal and electrical properties depending on the application.

In accordance with the present invention, a Metallic Injection Molding Material (MIM) can be used to injection mold a thermally conductive part and achieve the desirable complex geometries for heat sinks. The MIM materials allow thermal conductivity, but do not provide the conductivities seen in machined pure metals or in the prior art thermally conductive polymer compositions. Since the conductivities are not of the level seen in the prior art compositions, the use of MIM materials has, to this point, been undesirable.

Referring back to FIG. 3, a thermally conductive MIM material, such as aluminum, as a base matrix 12 is shown to provide a conductive material to bridge the interfaces and transitions seen between the filler materials 16. This composition also enhances the thermal conductivity of the base MIM material by creating enhanced pathways for conductivity within the molded composition 30. As can be seen, the highly conductive filler material 16 provides conductive paths within the composition 30 and the conductivity of the base MIM material 12 provides a conductive bridge between the gaps in the filler material 16. As a result, a highly thermally conductive composition is achieved.

In FIG. 4, a composition 100 of an alternative embodiment of the present invention is shown employing the high aspect ratio filler of FIGS. 5–8 and the low aspect ratio filler of FIGS. 9 and 10. Composition 100 includes a base matrix 112 that is preferably a metallic material, such as a MIM material. Loaded into the MIM base matrix 112 are low aspect ratio filler 114 and high aspect ratio filler 116 which are both highly thermally conductive materials. The present invention is the employment of both low aspect ratio filler 114 and high aspect ratio filler 116 within the same base matrix 112. The embodiment of FIG. 4 of the present invention employs low aspect filler 114 to fills the voids naturally left between adjacent high aspect ratio filler due to turbulence during molding and complex mold geometries. This may yield better results in certain thermal applications. As a result of the employment of both low aspect ratio filler and high aspect ratio filler within the same composition, the overall number of transitions surfaces can be greatly reduced while replacing the voids with low aspect ratio filler which were previously filled with the lower thermal conductivity MIM base matrix 12 as shown in FIG. 3. However, the use of high aspect ratio filler alone, as shown in FIG. 3, is suitable in most applications.

In the composite mixture of the present invention, it is preferred that, by volume, the base matrix 12 be 30 to 60 percent; that the high aspect ratio filler 116 be 25 to 50 percent; and that the low aspect ratio filler 114 be 10 to 25 percent. With the foregoing disclosed ranges, high volume loading and proper wet-out can be achieved.

In view of the foregoing, a superior formable highly thermally conductive composite material can be realized. The composition of the present invention, greatly improves over prior art attempts to provide such a heat conductive material while improving conductivity throughout heat sinks employing metallic base materials. In particular, the present invention provides thermal conductivity that is vastly improved over known compositions to permit complex part geometries to achieve more efficient heat sink devices.

It would be appreciated by those skilled in the art that various changes and modifications can be made to the illustrated embodiments without departing from the spirit of the present invention. All such modifications and changes are intended to be covered by the appended claims.

What is claimed is:

1. A method of foaming a high thermally conductive article, comprising the steps of:

providing a metallic base matrix of, by volume, between 30 and 60 percent;

providing a first thermally conductive filler, by volume, between 25 and 60 percent; the first thermally conductive filler having an aspect ratio of at learnt 10:1;

providing a second thermally conductive filler, by volume, between 10 and 25 percent; the second thermally conductive filler having an aspect ratio of less than 5:1; and mixing the first thermally conductive filler, the second thermally conductive filler and the metallic base matrix so that the first thermally conductive filler and the second thermally conductive filler are evenly dispersed throughout the metallic base matrix to form an entirely uniform molding composition;

injection molding the uniform composition into a unitary monolithic thermally conductive article; the first thermally conductive filler and the second thermally conductive filler and the base matrix therein cooperating to reduce the number of thermal interface gaps in said monolithic thermally conductive article.

2. The method of claim 1, wherein said base matrix is a Metal Injection Molding Material selected from the group consisting of aluminum, copper, brass, alumina and magnesium.

3. The method of claim 1 ,wherein said first thermally conductive filler has particles that are substantially flake-shaped.

4. The method of claim 1, wherein said first thermally conductive filler has particles that are substantially rice-shaped.

5. The method of claim 1, wherein said first thermally conductive filler has particles that are substantially strand-shaped.

6. The method of claim 1, wherein said first thermally conductive filler has particles that are substantially whisker-shaped.

7. The method of claim 1, wherein said first thermally conductive filter is a material selected from the group consisting of aluminum, alumina, copper, magnesium, brass and carbon.

8. The polymer composition of claim 1, wherein said second thermally conductive filler material is boron nitride grains.

9. The molding composition of claim 1, wherein said second thermally conductive filler has particles that are substantially grain shaped.

10. The molding composition of claim 1, wherein said second thermally conductive filler is a material selected from the group consisting of aluminum, alumina, copper, magnesium, brass, boron nitride and carbon.

11. A method of forming a high thermally conductive article, comprising the steps of:

providing a metallic base matrix of, by volume, between 30 and 60 percent;

providing a first thermally conductive filter, by volume, between 25 and 60 percent; the first thermally conductive filler having an aspect ratio of at least 10:1;

providing a second thermally conductive filter, by volume, between 10 and 25 percent; the second thermally conductive filler having an aspect ratio of less than 5:1; and mixing the first thermally conductive filler, the second thermally conductive filler and the metallic base matrix so that the first thermally conductive filler end the second thermally conductive filler are evenly dispersed throughout the metallic base matrix to form an entirely uniform molding composition;

casting the uniform composition into a unitary monolithic thermally conductive article; the first thermally conductive filler and the second thermally conductive filler and the base matrix therein cooperating to reduce the number of thermal interface gaps in said monolithic thermally conductive article.

12. The method of claim 11, wherein said base matrix is a Metal Injection Molding Material selected from the group consisting of aluminum, copper, brass, alumina and magnesium.

13. The method at claim 11, wherein said first thermally conductive filler has particles that are substantially flake-shaped.

14. The method of claim 11, wherein said first thermally conductive filler has particles that are substantially rice-shaped.

15. The method of claim 11, wherein said first thermally conductive filler has particles that are substantially strand-shaped.

16. The method of claim 11, wherein said first thermally conductive filler has particles that are substantially whisker-shaped.

17. The method of claim 11, wherein said first thermally conductive filler is a material selected from the group consisting of aluminum, alumina, copper, magnesium, brass and carbon.

18. The polymer composition of claim 11, wherein said second thermally conductive filler material is boron nitride grains.

19. The molding composition of claim 11, wherein said second thermally conductive filler has particles that are substantially grain shaped.

20. The molding composition of claim 11, wherein said second thermally conductive filler is a material selected from the group consisting of aluminum, alumina, copper, magnesium, brass, boron nitride and carbon.

* * * * *